US009153408B2

(12) United States Patent
Neuser et al.

(10) Patent No.: US 9,153,408 B2
(45) Date of Patent: Oct. 6, 2015

(54) MICROFOCUS X-RAY TUBE FOR A HIGH-RESOLUTION X-RAY APPARATUS

(75) Inventors: Eberhard Neuser, Wunstorf (DE); Andreas Schmitt, Wunstorf (DE); Wolfgang Johannes Sperner, Wunstorf (DE)

(73) Assignee: GE Sensing & Inspection Technologies GmbH, Hurth (DE)

( * ) Notice: Subject to any disclaimer, the term of this patent is extended or adjusted under 35 U.S.C. 154(b) by 320 days.

(21) Appl. No.: 13/818,994

(22) PCT Filed: Aug. 27, 2010

(86) PCT No.: PCT/EP2010/005273

§ 371 (c)(1), (2), (4) Date: Apr. 22, 2013

(87) PCT Pub. No.: WO2012/025136

PCT Pub. Date: Mar. 1, 2012

(65) Prior Publication Data

US 2013/0208870 A1 Aug. 15, 2013

(51) Int. Cl.

*H01J 35/12* (2006.01)
*H01J 35/14* (2006.01)
*H01J 35/10* (2006.01)
(Continued)

(52) U.S. Cl.

CPC ..... *H01J 35/12* (2013.01); *H01J 35/105* (2013.01); *H01J 35/14* (2013.01); *H01J 35/16* (2013.01); *H05G 1/025* (2013.01); *H01J 2235/087* (2013.01); *H01J 2235/12* (2013.01); *H01J 2235/1216* (2013.01); *H01J 2235/1262* (2013.01); *H01J 2235/1266* (2013.01)

(58) Field of Classification Search

CPC ..... H01J 35/105; H01J 35/12; H01J 35/14; H01J 35/16; H01J 2235/087; H01J 2235/12; H01J 2235/1216; H01J 2235/1262; H01J 2235/1266

USPC ..... 378/130, 137, 138, 141, 199, 200

See application file for complete search history.

(56) References Cited

U.S. PATENT DOCUMENTS 1,917,099 A 7/1933 Coolidge
2,356,645 A 8/1944 Atlee
(Continued)

FOREIGN PATENT DOCUMENTS

CN 1910968 A 2/2007
CN 101026077 A 8/2007
(Continued)

OTHER PUBLICATIONS

Unofficial English translation of JP Office Action issued Apr. 1, 2014 in connection with corresponding JP Patent Application No. 2013-525146.

(Continued)

*Primary Examiner* — Allen C. Ho

(74) *Attorney, Agent, or Firm* — GE Global Patent Operation; Douglas D. Zhang

(57) ABSTRACT

An apparatus is provided for a micro focus X-ray tube for a high-resolution X-ray including a housing, an electron beam source for generating an electron beam and a focusing lens for focusing the electron beam on a target. The micro focus X-ray tube includes a substantially rotationally symmetrical, ring-shaped cooling chamber configured to circulate a liquid cooling medium.

11 Claims, 4 Drawing Sheets

(51) Int. Cl.

| | |
|---|---|
| ***H01J 35/16*** | (2006.01) |
| ***H05G 1/02*** | (2006.01) |

(56) References Cited

U.S. PATENT DOCUMENTS

| | | | | |
|---|---|---|---|---|
| 2,608,664 | A | 9/1945 | Buechner | |
| 6,249,569 | B1 * | 6/2001 | Price et al. | 378/130 |
| 6,430,263 | B1 | 8/2002 | Lu | |
| 6,438,207 | B1 * | 8/2002 | Chidester et al. | 378/138 |
| 6,580,780 | B1 * | 6/2003 | Miller | 378/141 |
| 6,852,982 | B1 | 2/2005 | Bierhoff et al. | |
| 6,977,991 | B1 * | 12/2005 | Neumeier et al. | 378/141 |
| 7,025,502 | B2 * | 4/2006 | Freudenberger et al. | 378/200 |
| 7,197,118 | B2 * | 3/2007 | Anno et al. | 378/130 |
| 7,443,957 | B2 * | 10/2008 | Freudenberger et al. | 378/130 |
| 7,499,525 | B2 * | 3/2009 | Horndler et al. | 378/130 |
| 7,508,916 | B2 * | 3/2009 | Frontera et al. | 378/130 |
| 7,515,687 | B2 | 4/2009 | Bernard et al. | |
| 7,520,672 | B2 * | 4/2009 | Thangamani et al. | 378/199 |
| 7,522,706 | B2 | 4/2009 | Lu et al. | |
| 7,558,376 | B2 * | 7/2009 | Anno | 378/130 |
| 7,580,507 | B2 * | 8/2009 | Lu et al. | 378/141 |
| 8,009,805 | B2 * | 8/2011 | Smith et al. | 378/130 |
| 8,009,806 | B2 * | 8/2011 | Legall | 378/132 |
| 2007/0230662 | A1 * | 10/2007 | Imai et al. | 378/130 |
| 2009/0225951 | A1 * | 9/2009 | Wandke et al. | 378/141 |
| 2010/0046715 | A1 * | 2/2010 | Freudenberger | 378/140 |

FOREIGN PATENT DOCUMENTS

| | | | |
|---|---|---|---|
| EP | 1970935 | | 9/2008 |
| GB | 235892 | | 11/1925 |
| JP | 03152844 | A | 6/1991 |
| JP | 2001006592 | A | 1/2001 |
| JP | 2004055262 | A | 2/2004 |
| JP | 2004079304 | A | 3/2004 |
| JP | 2005038857 | A | 2/2005 |
| JP | 2006128137 | A | 5/2006 |
| JP | 2009123555 | A | 6/2009 |

OTHER PUBLICATIONS

PCT Search Report and Written Opinion from corresponding PCT Application No. PCT/EP2010/005273, Dated May 20, 2011.

Translation of CN office Action issued on Feb. 28, 2015 in relation to corresponding CN application 201080068842.0.

Unofficial English translation of Notice of Allowance issued in connection with corresponding JP Application No. 2013-525146 on Dec. 1, 2014.

* cited by examiner

MICROFOCUS X-RAY TUBE FOR A HIGH-RESOLUTION X-RAY APPARATUS

This is a national stage application under 35 U.S.C. §371 (c) of prior-filed, co-pending PCT patent application serial number PCT/EP2010/005273, filed on Aug. 27, 2010, the entire contents of which are incorporated herein by reference.

BACKGROUND OF THE INVENTION

Embodiments of the present invention relate to a micro focus X-ray tube for a high-resolution X-ray device comprising a housing, an electron beam source for generating an electron beam, and a focusing lens for focusing the electron beam onto a target. Such X-ray tubes are known, for example, for high-resolution computer tomography devices.

Due to advances in detector technology, in computing and in storage capacities as well as the increased resolution of micro focus X-ray tubes, the micro-CT allows the volume reconstruction with a very high spatial resolution (voxel size) up to the sub-micrometer range.

Since the measurement of all the X-ray projections, which are required for a reconstruction with high resolution, takes several hours typically, thermally induced displacements of the sample projections create significant problems on the detector. Although it is known that these displacements are compensated using software-based algorithms, the resolution improvement thus achieved is limited.

The critical component is the X-ray tube, because it is not possible to fix the tube in the focal spot on a thermally insensitive manipulator; it always remains a thermo sensitive (usually metallic) connection over the tubular housing between the focus and the attachment of the tube on the manipulator, which, without further measures leads to the fact that the focus position of the X-ray tube over the duration of measurement moves considerably.

A common measure, to keep the focus position of the x-ray tube over the entire measurement period as constant as possible, consists of heating up the tube to operating temperature and waiting until a thermal equilibrium is reached before the scans are started. However, it takes several hours until the thermal equilibrium is reached because of the considerable mass of the X-ray tube and the associated large heat capacity. Furthermore, the thermal equilibrium is disturbed again with each parameter change of the tube, causing additional significant delays.

The objective of the embodiments of the invention is to provide a micro-focus X-ray tube which allows, in the industrial application, to obtain data in a shorter time with a higher resolution.

BRIEF DESCRIPTION OF THE INVENTION

Provided is a micro focus X-ray tube for a high resolution X-ray apparatus, the X-ray tube comprising a housing, an electron beam source for generating an electron beam and a focusing lens for focusing the electron beam on a target, wherein the X-ray tube comprises a substantially rotationally symmetrical, ring-shaped cooling chamber configured to circulate a liquid cooling medium.

BRIEF DESCRIPTION OF THE DRAWINGS

Embodiments of the present invention are explained below on the basis of advantageous embodiments with reference to the following accompanying drawings.

DETAILED DESCRIPTION OF THE INVENTION

Figure 1:
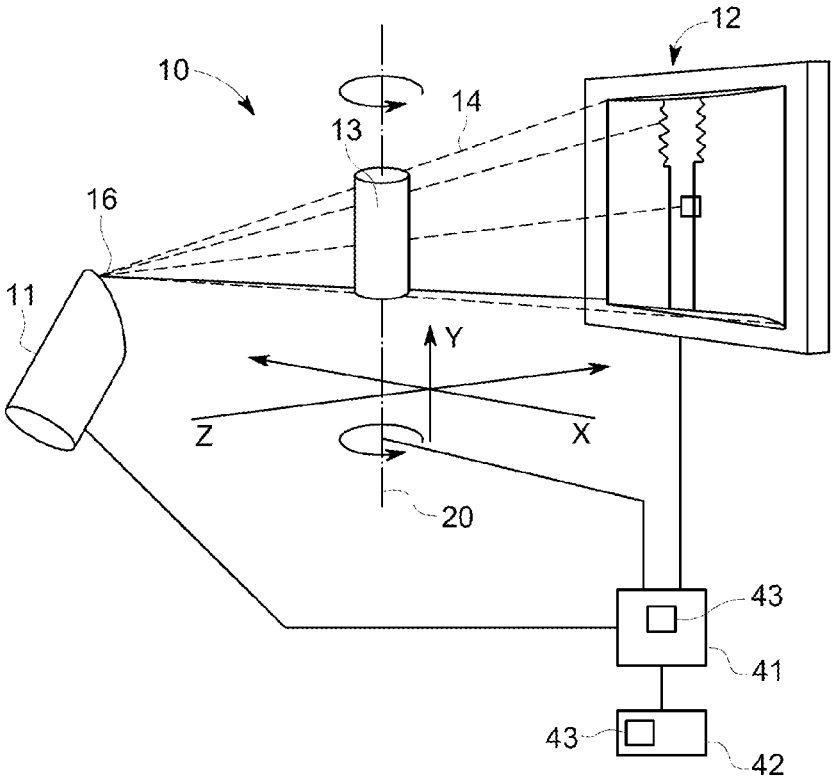
FIG. 1 is a schematic representation of a micro-computer tomography system.

As shown in FIG. 1, micro computed tomography apparatus comprising an x-ray system 10, which is adapted to receive a set of X-ray projections of a sample 13. For this purpose, the X-ray system 10 comprises a micro focus X-ray tube 11, the X-ray radiation 14, emitted on basis of a focal point or focus 16 of the micro focus X-ray tube 11, an imaging X-ray detector 12, and a sample holder 20, which is set up to rotate the sample 13 about a vertical axis. X-ray detector 12 is a surface detector, in particular a flat panel detector, however, a line detector is also possible. A set of x-ray projections of the sample 13, each receives for example, a defined small angle step and recording an x-ray projection at each angle of rotation by gradually rotating the sample holder 20. The X-ray system 10 is not limited to a rotation of the sample holder 20 about a vertical axis. Alternatively, for example, the micro focus X-ray tube 11 and the X-ray detector 12 are rotated about the stationary sample 13.

The X-ray projections are read from the X-ray detector 12 and transmitted to a computing device 41, where reconstructed three-dimensional volume data 43 of the sample 13 can be calculated from the set of recorded x-ray projections by means of a basically known reconstruction algorithm and, for example displayed on a screen 42. The computing device 41, as shown in FIG. 1, can also be set up to control the micro focus X-ray tube 11, the sample holder 20 and the X-ray detector 12, alternatively, a separate control device can be provided.

The micro focus X-ray tube 11 includes a cathode element 15, a Wehnelt cylinder 21, an anode 19, a focusing lens 22 designed as an electromagnetic lens and an electron beam target 23. Furthermore, a further electromagnetic lens 25 may be provided, which is set up as a condenser lens, around the electron beam 24 approximately aligned parallel or to generate an intermediate image, and the condenser lens 25 is however not absolutely necessary. The micro focus X-ray tube 11 also expediently includes a not shown deflector for beam position adjustment. The micro focus X-ray tube 11 is arranged so that the minimum focus or focal spot on the electron beam target 23 is smaller than or equal to 10 μm.

The micro focus X-ray tube 11 further comprises a housing, which can be composed of a plurality of sections. In particular, a housing portion 35 can be provided which accommodates the cathode element 15 and forms the anode 19, a housing portion 36 may be provided which surrounds a focusing lens 22 and, optionally, there may be an intermediate arranged middle housing portion 37, in which, for example, the condenser lens 25 may be arranged. The coil 33 in the housing portion 36 is free of thermal insulation, in particular non-metallic screens or layers that would impede the setting of a thermal equilibrium.

The micro focus X-ray tube 11 comprises an annular cooling chamber 30, which has an inlet 31 and an outlet 32 which are connected to a cooling circuit via coolant lines 38, with a coolant pump 44. In this manner, a liquid coolant, in particular water or oil, flow through the cooling chamber 30 so that the input of heat energy from a variety of internal and external heat sources and an associated displacement of the focal point 16 counteract relative to the tube mounting 39. The mentioned heat sources arise, for example due to the impact of the electron beam 24 on the electron beam target 23, the energy dissipation in the focusing lens 22 and the absorption of thermal energy over the surface of the tube housing 34.

Figure 3:
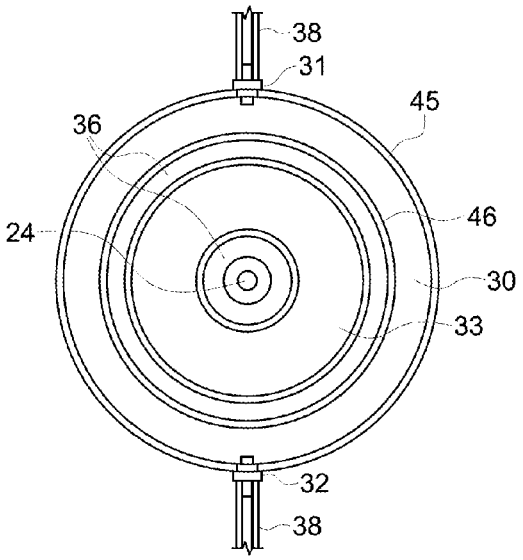
FIG. 3 is a cross section through an X-ray tube perpendicular to the longitudinal axis.
Figure 6:
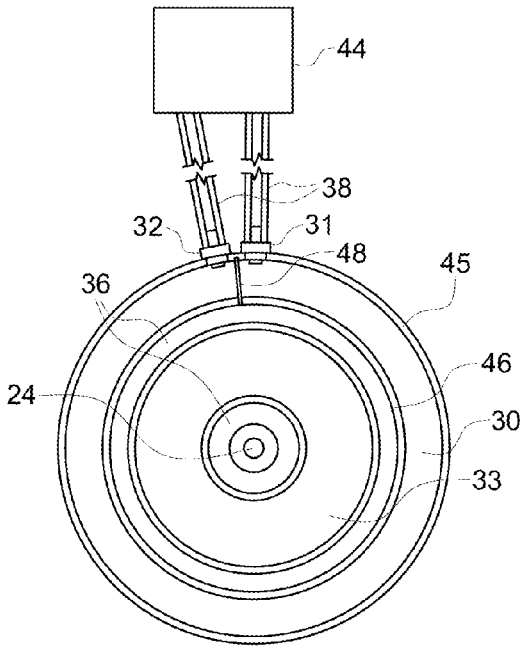
FIG. 6 is a cross section through an X-ray tube perpendicular to the longitudinal axis, in an alternative embodiment to FIG. 3.

The cooling chamber 30 is closed in a ring, as best seen in FIGS. 3 and 6. In the embodiment of FIG. 3, the liquid flowed through the interior of the cooling chamber 30 is circumferentially completely throughout. In this embodiment, inlet 31 and outlet 32 are offset by 180° to each other, ie, oppositely arranged, as shown in FIG. 3, so that the cooling chamber 30 is passed through as uniformly as possible and no preferential direction of flow for the cooling medium forms.

In the embodiment of FIG. 6, however, a radial partition 48 is provided in the cooling chamber 30, which interrupts the fluid flowed through the interior of the cooling chamber 30 at a point on the circumference. In this case the inlet 31 and outlet 32 are arranged suitably in the region of the radial partition 48 on opposite sides of the same in order to achieve a full flow through the cooling chamber 30. In this embodiment, the inlet 31 and outlet 32 can also be essentially without circumferential offset, but instead can be arranged axially offset.

The embodiment according to FIG. 6 illustrates that the inventive feature "substantially rotationally symmetrical" means: rotationally symmetrical apart from inlets and outlets 31, 32 for the coolant, any radial partition 48 in the cooling chamber 30, and optionally further, the rotational symmetry not substantially interfering functional elements. The terms axial, radial and rotational symmetry refers in this application to the longitudinal axis of the micro focus X-ray tube 11, which is defined by the central axis of the electron beam 24 between the cathode 15 and the electron beam target 23.

Figure 2:
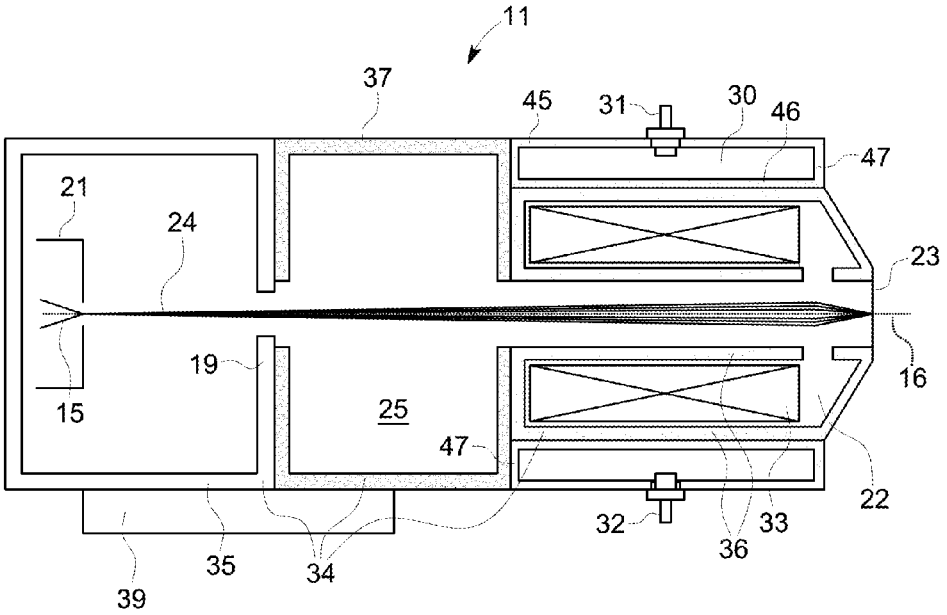
FIG. 2 is a schematic representation of a micro-focus X-ray tube.

In the embodiment of FIG. 2, the cooling chamber 30 is arranged to the tube housing 34, in particular the focusing lens 22 is disposed around the surrounding housing portion 36. In this embodiment, the cooling chamber 30 extends substantially axially, i.e. its axial extension is approximately at least twice as large as their radial extension. For example, the axial extent of the cooling chamber 30 to the axial extent of the coil 33 of the focusing lens 22 can be adjusted.

Figure 4:
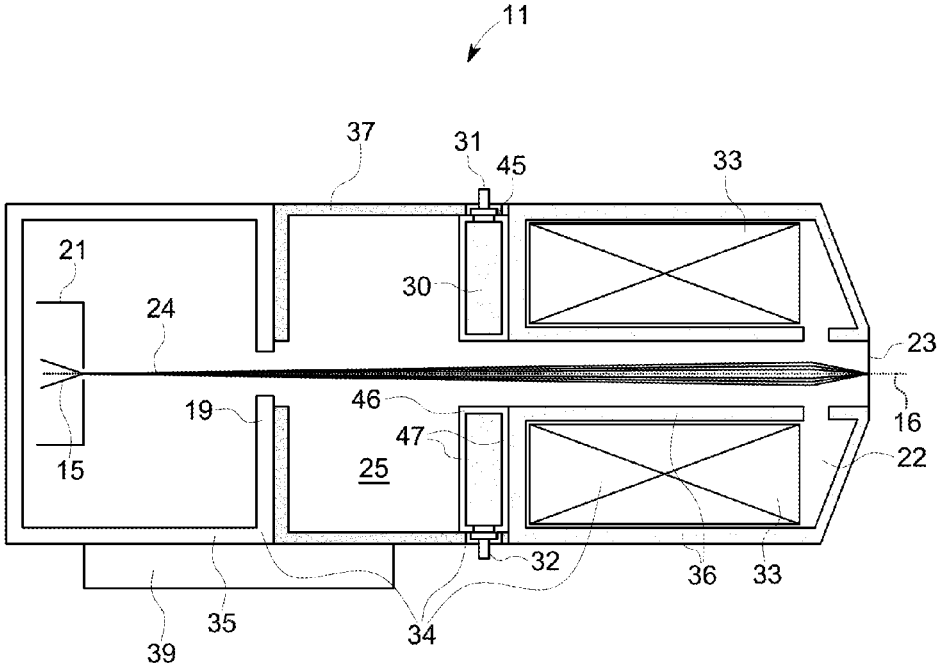
FIG. 4 is a longitudinal cross section through an X-ray tube in an embodiment.
Figure 5:
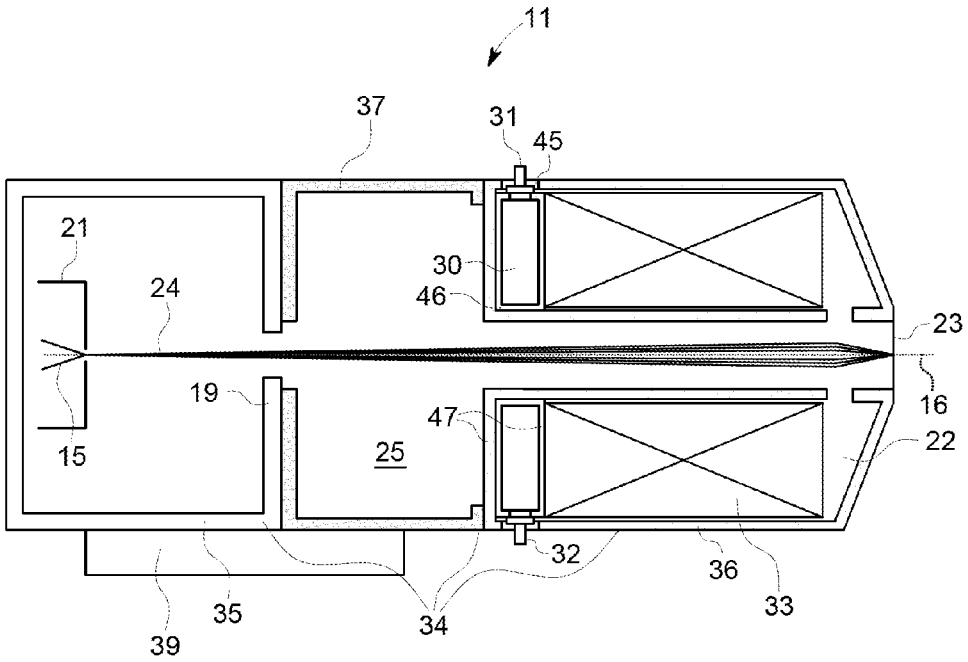
FIG. 5 is a longitudinal cross section through an X-ray tube in an embodiment.

In the embodiments of FIGS. 4 and 5, the cooling chamber 30 is arranged in the tube housing 34. In the variant shown in FIG. 4, the cooling chamber 30 is arranged on the outside on the focusing lens 22 surrounding housing portion 36, here in the middle housing portion 37. In the variant shown in FIG. 5, the cooling chamber 30 is arranged directly in the focusing lens 22 surrounding housing portion 36 adjacent to the coil 33. In both embodiments, the cooling chamber 30 extends mainly radially, i.e. its radial extension is at least approximately 50% greater than their axial extent. For example, the radial extent of the cooling chamber 30 to the radial extent of the coil 33 of the focusing lens 22 can be adjusted.

In the embodiments according to FIGS. 2, 4 and 5, the cooling chamber 30 is arranged adjacent to the coil 33 of the focusing lens 22, as this is a main source of heat in the micro focus X-ray tube 11. But embodiments of the invention are not limited to an arrangement of the cooling chamber 30 adjacent to the focusing lens 22.

In the embodiments according to FIGS. 2 to 6, the cooling chamber 30 has the form of an annular cylinder. The radial outer wall 45 and the radial inner wall 46 of the cooling chamber 30 are thus cylindrically shaped. The side walls 47 required for the formation of closed cooling chamber 30 are disk shape.

The cooling chamber 30 forming walls 45, 46, 47 comprise a material having a good thermal conductivity of at least 50 W/mK, in particular made of a material with a basis of aluminum, copper and/or brass.

As can be seen from the FIGS. 2, 4 and 5, the cross sectional area of the cooling chamber 30 in a longitudinal cross-section is more than ten times as large as the cross-sectional area of coolant lines 38 to be connected with the cooling chamber 30 via the connections 31, 32. The flow rate of the cooling medium in the cooling chamber 30 is more than ten times smaller than in the coolant lines 38 to be connected to cooling chamber 30 via the connections 31, 32. The clear internal dimensions of the cooling chamber 30 in a longitudinal cross-section is substantially greater than the wall thickness of the walls 45 to 47, so that as much of the available space is used as a coolant flow. The aforementioned features contribute to the efficient cooling due to maximum cooling volume in the cooling chamber 30 at a given size.

Embodiments of the present invention are not limited to a coolant inlet 31, a coolant outlet 32 and, optionally, a radial partition 48. There are other embodiments conceivable having a plurality of coolant inlets 31, a plurality of coolant outlets 32 and/or a plurality of radial partitions 48.

The micro focus X-ray tube 11 may have a plurality of cooling chambers 30, which may be, for example, axially offset from one another.

The cooling chamber 30 has been described above in connection with a micro focus X-ray tube 11 with an electron beam target 23. The cooling chamber 30 may be used without further alternative easily into a micro focus X-ray tube 11 with a direct beam geometry, i.e. with reflective target.

The micro focus X-ray tube 11 has been described above for the preferred application in a CT apparatus. However, there are other applications conceivable for industrial X-ray inspection or x-ray measurement of components. In general, the micro focus X-ray tube 11 can be used in a high-resolution X-ray device having an imaging detector.

Due to the cooling of the micro focus X-ray tube 11 by means of the cooling medium flowing through the cooling chamber 30, the thermally induced displacements of the focus position is counteracted. A feature here is that the cooling chamber 30 according to embodiments of the invention is essentially rotationally symmetric. Thereby, the substantially rotationally symmetrical temperature distribution in the micro focus X-ray tube 11, which is mainly produced through rotationally symmetrical heat input, in particular due to the dissipation of energy in the electron optical system and the absorption of thermal energy over the surface of the tube housing 34, is obtained upright, also when the micro focus X-ray tube 11 is not in thermal equilibrium. By the maintenance of the rotationally symmetrical temperature distribution in the micro focus X-ray tube 11, lateral displacements of the focus, i.e. displacements in the direction perpendicular to the rotational axis arranged focal plane, can be suppressed very effectively. As these displacements in the focal plane have a large influence on the spatial resolution of the X-ray detector 12, according to embodiments of the invention, significant increase the spatial resolution in the volume reconstruction can be achieved. A preheating of the micro focus X-ray tube 11 and waiting for adjusting the thermal balance can be omitted, which reduces the total duration of measurement.

Due to the essentially rotationally symmetrical cooling, according to embodiments of the invention, essentially only axial thermal displacement of the focal point remains. These have a less damaging effect on the spatial resolution of the X-ray detector 12. Furthermore, if necessary, the axial thermal displacements of the focal point by means of an increased cooling capacity, i.e. a properly designed cooling pump, can be effectively prevented.

Through the annular cooling chamber 30, the embodiments of the invention is distinguished by a particular cooling line helically disposed about the axis of rotation, where in particular, deviations occur in the axial end regions by the rotational symmetry of the cooling.

In an embodiment, the cross-sectional area of the cooling chamber 30 is, at least five times in a longitudinal cross section, as large as the cross-sectional area of the coolant lines 38 to be connected to cooling chamber 30. This feature contributes to a particularly efficient cooling because of the greatest possible cooling volume in the cooling chamber 30 for a given size. For the same reason, the clear internal dimensions of the cooling chamber 30 are greater in a longitudinal cross-section than the wall thickness of the cooling chamber 30, so that as much of the available space is used as a coolant volume.

In an embodiment, the cooling chamber 30 is formed annularly cylindrical, wherein a radial inner wall 46 and a radial outer wall 45 of the cooling chamber 30 are shaped cylindrically. This form allows for efficient cooling because of a greatest possible volume of cooling at a given size, and is also advantageous in view of manufacturing technology.

In an embodiment, an inlet and an outlet for the cooling medium are arranged mutually offset in the circumferential direction of the tube, offset by at least approximately 90°. This arrangement can contribute to a possible uniform flow through the entire cooling chamber volume.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A micro focus X ray tube for a high resolution X-ray apparatus, the X-ray tube comprising: a housing having; an electron beam source for generating an electron beam; a focusing lens for focusing the electron beam; and a substantially rotationally symmetrical, ring-shaped cooling chamber positioned within the housing surrounding the focusing lens configured to circulate a liquid cooling medium.

2. The micro focus X-ray tube according to claim 1, wherein a cross-sectional area of the cooling chamber in a longitudinal cross section is at least five times as large as a cross-sectional area of at least one coolant line, the coolant line connected to the cooling chamber.

3. The micro focus X-ray tube according to claim 1, wherein the cooling chamber comprises an orifice and at least one wall and wherein an internal dimension of the cooling chamber orifice in a longitudinal cross-section is larger than a wall thickness of the at least one cooling chamber wall.

4. The micro focus X-ray tube according to claim 1, wherein the cooling chamber comprises the shape of an annular cylinder.

5. The micro focus X-ray tube according to claim 1, wherein the micro focus X-ray tube comprises an inlet and an outlet for the liquid cooling medium and wherein the inlet and the outlet in a circumferential direction of the cooling chamber are arranged offset to one another.

6. The micro focus X-ray tube according to claim 1, wherein the micro focus X-ray tube comprises an inlet and an outlet for the liquid cooling medium and wherein the inlet and the outlet for the cooling medium are arranged opposite with respect to a tube axis.

7. The micro focus X-ray tube according to claim 1, wherein the focusing lens comprises a coil and wherein the cooling chamber is arranged adjacent to the coil of the focusing lens.

8. The micro focus X-ray tube according to claim 1, wherein the cooling chamber comprises a wall, the wall comprising a material having a thermal conductivity of at least 50 W/mK.

9. The micro focus X-ray tube according to claim 1, wherein the cooling chamber comprises a wall, the wall comprises at least one of a material on the basis of aluminum, copper and brass.

10. A micro focus X-ray tube for a high resolution X-ray apparatus, the X-ray tube comprising: a housing having: an electron beam source for generating an electron beam; a focusing lens for focusing the electron beam; and a substantially rotationally symmetrical, ring-shaped cooling chamber surrounding the focusing lens, the cooling chamber including a cooling circuit and an inlet and an outlet connected to the cooling circuit.

11. The micro focus X-ray tube according to claim 10, wherein the cooling circuit includes a pump.

* * * * *